US009476596B2

(12) United States Patent
Asofsky et al.

(10) Patent No.: US 9,476,596 B2
(45) Date of Patent: Oct. 25, 2016

(54) FUNCTION INDICATOR SYSTEM FOR ELECTRIC FIREPLACE

(75) Inventors: Mark Asofsky, Delray Beach, FL (US); Tyler Nemes, Delray Beach, FL (US)

(73) Assignee: TWIN-STAR INTERNATIONAL, INC., Delray Beach, FL (US)

( * ) Notice: Subject to any disclaimer, the term of this patent is extended or adjusted under 35 U.S.C. 154(b) by 629 days.

(21) Appl. No.: 12/573,933

(22) Filed: Oct. 6, 2009

(65) Prior Publication Data

US 2011/0080261 A1 Apr. 7, 2011

(51) Int. Cl.
*F24C 7/08* (2006.01)
*F24C 7/00* (2006.01)

(52) U.S. Cl.
CPC ..... *F24C 7/004* (2013.01); *F24C 7/081* (2013.01); *F24C 7/082* (2013.01); *F24C 7/085* (2013.01); *F24C 7/086* (2013.01); *F24C 7/087* (2013.01); *F24C 7/088* (2013.01)

(58) Field of Classification Search
CPC ..... F24C 7/004; F24C 7/081; F24C 7/086; F24C 7/088; F24C 7/082; F24C 7/087; F24C 7/085
USPC ..... 40/428
See application file for complete search history.

(56) References Cited

U.S. PATENT DOCUMENTS 2,448,906 A 9/1948 Munao
2,984,032 A 9/1958 Cornell
3,444,637 A 5/1969 Joy
3,742,189 A 6/1973 Conroy et al.
5,635,898 A 6/1997 Walters et al.
5,642,580 A * 7/1997 Hess ..... F21S 10/04 40/428
5,724,261 A 3/1998 Denny
5,826,357 A * 10/1998 Hechler ..... A47B 81/06 348/E5.128
6,047,489 A * 4/2000 Hess ..... F21S 10/04 392/348
6,050,011 A * 4/2000 Hess ..... F21S 10/04 40/427
6,269,567 B1 * 8/2001 MacPherson ..... F21S 10/04 392/348
6,363,636 B1 * 4/2002 Hess ..... F21S 10/04 40/428

(Continued)

FOREIGN PATENT DOCUMENTS

WO 2009068518 4/2009

OTHER PUBLICATIONS http://web.archive.org/web/20080801210244/http://www.electricfireplacesdirect.com/products-accessories/TV-media-consoles/Beverly-23-Espresso-Media-Console-Electric-Fireplace-Cabinet-Mantel-Package; dated Aug. 1, 2008.*

(Continued)

*Primary Examiner* — Bao-Luan Le
(74) *Attorney, Agent, or Firm* — Johnson & Martin, P.A.; James David Johnson

(57) ABSTRACT

A function indicator system for displaying the control settings related to functions and features of an electric fireplace. The function indicator system can feature a function indicator module, a controller communicatively connected to the function indicator module, and a power source electrically connected to the function indicator module. The function indicator module can contain a plurality of light sources that emit paths of light, which can pass through control status indicia to create a visual display on an exterior surface of a projection screen of the electric fireplace. The visual display is visible to a viewer so as to alert the viewer as to the particular status of a control setting of the electric fireplace such as, for example, the temperature of heat produced, the brightness of simulated flames, or the length of time that the user desires for the electric fireplace to operate prior to automatic shutdown.

18 Claims, 8 Drawing Sheets

(56) References Cited

U.S. PATENT DOCUMENTS

| | | | | |
|---|---|---|---|---|
| 6,393,207 | B1 | 5/2002 | Martin | |
| 6,748,942 | B2 * | 6/2004 | Bachinski | F24C 3/122 126/503 |
| 6,919,884 | B2 * | 7/2005 | Mix | F24B 1/1808 345/204 |
| 7,080,472 | B2 | 7/2006 | Schroeter et al. | |
| 7,322,819 | B2 | 1/2008 | Lyons | |
| 7,373,743 | B1 | 5/2008 | Hess | |
| 7,451,759 | B2 | 11/2008 | Weiss | |
| 7,686,471 | B2 | 3/2010 | Reichow | |
| 2002/0139021 | A1 * | 10/2002 | Hess | G09F 19/00 40/428 |
| 2004/0169588 | A1 | 9/2004 | Imamura | |
| 2004/0181983 | A1 * | 9/2004 | Hess | F21S 10/04 40/428 |
| 2005/0208443 | A1 * | 9/2005 | Bachinski | F23D 14/84 431/8 |
| 2006/0098428 | A1 | 5/2006 | Rosserot | |
| 2006/0099565 | A1 * | 5/2006 | Rosserot | F24C 7/004 434/365 |
| 2006/0213097 | A1 * | 9/2006 | Haugom | G09F 19/12 40/428 |
| 2007/0125367 | A1 * | 6/2007 | Lim | F24C 7/004 126/540 |
| 2007/0291506 | A1 * | 12/2007 | Nearhoof et al. | 362/600 |
| 2008/0013931 | A1 * | 1/2008 | Bourne | F24C 7/004 392/348 |
| 2008/0028648 | A1 | 2/2008 | O'Neill | |
| 2009/0080871 | A1 * | 3/2009 | Chiu | F24C 7/004 392/348 |
| 2009/0126241 | A1 * | 5/2009 | Asofsky | G09F 19/12 40/428 |
| 2009/0220221 | A1 * | 9/2009 | Zhou | F24C 7/004 392/348 |
| 2010/0218565 | A1 * | 9/2010 | Wan et al. | 68/13 R |

OTHER PUBLICATIONS

ClassicFlame™ Introduces Expanded Entertainment Center Portfolio at Las Vegas Summer Market; Jun. 22, 2007.*
http://web.archive.org/web/20080916091215/http://www.electricfireplacesdirect.com/products-accessories/Small-Electric-Fireplace-Packages; Sep. 16, 2008.*
http://web.archive.org/web/20081220111240/http://www.electricfireplacesdirect.com/products-accessories/Small-Electric-Fireplace-Packages/Strasburg-Vintage-Cherry-Electric-Fireplace-Roll-Away-Mantel-Package; Dec. 20, 2008.*

* cited by examiner

FUNCTION INDICATOR SYSTEM FOR ELECTRIC FIREPLACE

FIELD OF THE INVENTION

The invention relates to a feature and function status indicator system. More particularly, the invention relates to a system for indicating the control settings for various features and functions of an electric fireplace.

BACKGROUND

As a source of heat and for aesthetic reasons, fireplaces are frequently incorporated into homes. There are currently several fireplace options available to consumers: traditional fuel (wood or coal)-burning fireplaces, gas-burning fireplaces, and electric fireplaces. Traditional fuel-burning fireplaces generally offer the greatest heat-production and aesthetics, but require more set-up and maintenance time to operate. Gas-burning fireplaces offer a real flame and convenience, but lack the natural sound, flickering, and shadowing associated with traditional fuel-burning fires. Electric fireplaces do not offer a real flame, but have many safety and convenience features.

Traditional fuel-burning and gas-burning fireplaces as well as conventional electric fireplaces also lack a visually attractive display means for displaying control settings. For example, a conventional electric fireplace does not feature a lighted visual display by which a user can quickly and easily determine the currently selected control settings simply by looking at the electric fireplace.

SUMMARY

The invention relates to electric fireplaces having a function indicator system for producing a visual status display that alerts a user as to the status levels for one or more control settings features and functions of the electric fireplace. The function indicator system can feature an electric fireplace having a projection screen, a function indicator module, a controller, and a power source. The function indicator module can include a plurality of function indicator lights that emit a path of light, which passes through a control status indicia printed on a translucent film. Each of the printed control status indicia can be aligned with one or more function indicator lights so that the light emitted by the function indicator light or lights with which the indicia is aligned passes through the indicia to form a visual status display on an exterior surface of the electric fireplace's projection screen.

One advantage of incorporating the function indicator system in the construction of an electric fireplace is that a user or other viewers can easily and quickly determine the status of various control settings. For example, the user can view the visual status display projected onto the projection screen to determine the exact high, intermediate, or low settings of several control settings such as power control, heater temperature, blower or fan speed, simulated flame intensity, burning wood soundtrack volume, light brightness or intensity, or timer control.

Another advantage of the function indicator system is that the visual status display provides a modern, aesthetically pleasing means for viewing and controlling the control status settings for an electric fireplace.

Accordingly, the invention features a system for displaying the control settings for an electric fireplace. The system can include an electric fireplace, a function indicator module, a communicatively connected to the function indicator module, and a power source. The electric fireplace can include a projection screen, and the function indicator module can be installed on one side of the projection screen to create a visual status display of the electric fireplace's control settings on the projection screen.

In another aspect, the invention features the function indicator module including at least one function indicator light.

In another aspect, the invention features each function indicator light including a light-emitting diode (LED).

In another aspect, the invention features the visual status display created by the function indicator module being visible on an exterior surface of the projection screen.

In another aspect, the invention features each function indicator light including a visual status display for at least one of the following settings: power, temperature, light brightness, blower or fan speed, timer, flame control, and speaker volume.

In another aspect, the invention features the function indicator module being capable of varying the visual status display displayed on the projection screen based upon a user's selection of control settings levels.

In another aspect, the invention features the function indicator module having a housing that includes an open end and a closed end, at least one function indicator light installed on an interior surface of the closed end of the housing, and a visual display apparatus installed over the open end of the housing.

In another aspect, the invention features the visual display apparatus including a translucent film. The translucent film can feature printed control status indicia.

In another aspect, the invention features the visual display apparatus including an opaque plate. The opaque plate can feature at least one translucent section in alignment with a path of light emitted by at least one function indicator light.

In another aspect, the invention features at least one translucent section including printed control status indicia.

In another aspect, the invention features the visual display apparatus including an opaque plate. The opaque plate can feature at least one aperture aligned with a path of light emitted by at least one function indicator light.

In another aspect, the invention features the opaque plate including control status indicia positioned within the path of light passing through at least one aperture.

In another aspect, the invention features the function indicator module being installed behind an interior surface of the projection screen.

In another aspect, the invention features the function indicator module being installed on an interior surface of the projection screen.

In another aspect, the invention features the function indicator module being connected to a timer-controlled dimmer.

In another aspect, the invention features the controller including a user control interface comprising at least one set of control features selected from among the following: control buttons, a touchscreen comprising electronically displayed control keys, and a remote control.

In another aspect, the invention features the controller being a computer.

In another aspect, the invention features the controller being a circuit board that can include input and output ports to which the function indicator module is electrically and communicatively connectable.

A method of the invention can be used to visually display the control settings of an electric fireplace. The method can include the steps of: (a) projecting light emitted by a light source through a function indicator module that features control status indicia; (b) projecting light passing through the control function indicator module onto a projection screen of an electric fireplace to create a visual display of the electric fireplace's control settings on an exterior surface the projection screen; and (c) varying the characteristics of the visual display depending upon input from a user controlling the electric fireplace's control settings.

Another method of the invention includes the step of (d) projecting the visual display onto the projection screen for a predetermined period of time.

Another method of the invention includes the step of (e) dimming the light source creating the visual display after a predetermined period of time until the light source is turned off and the visual display disappears from the exterior surface of the projection screen.

Unless otherwise defined, all technical terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents and other references mentioned herein are incorporated by reference in their entirety. In the case of conflict, the present specification, including definitions will control.

DETAILED DESCRIPTION

Figure 1:
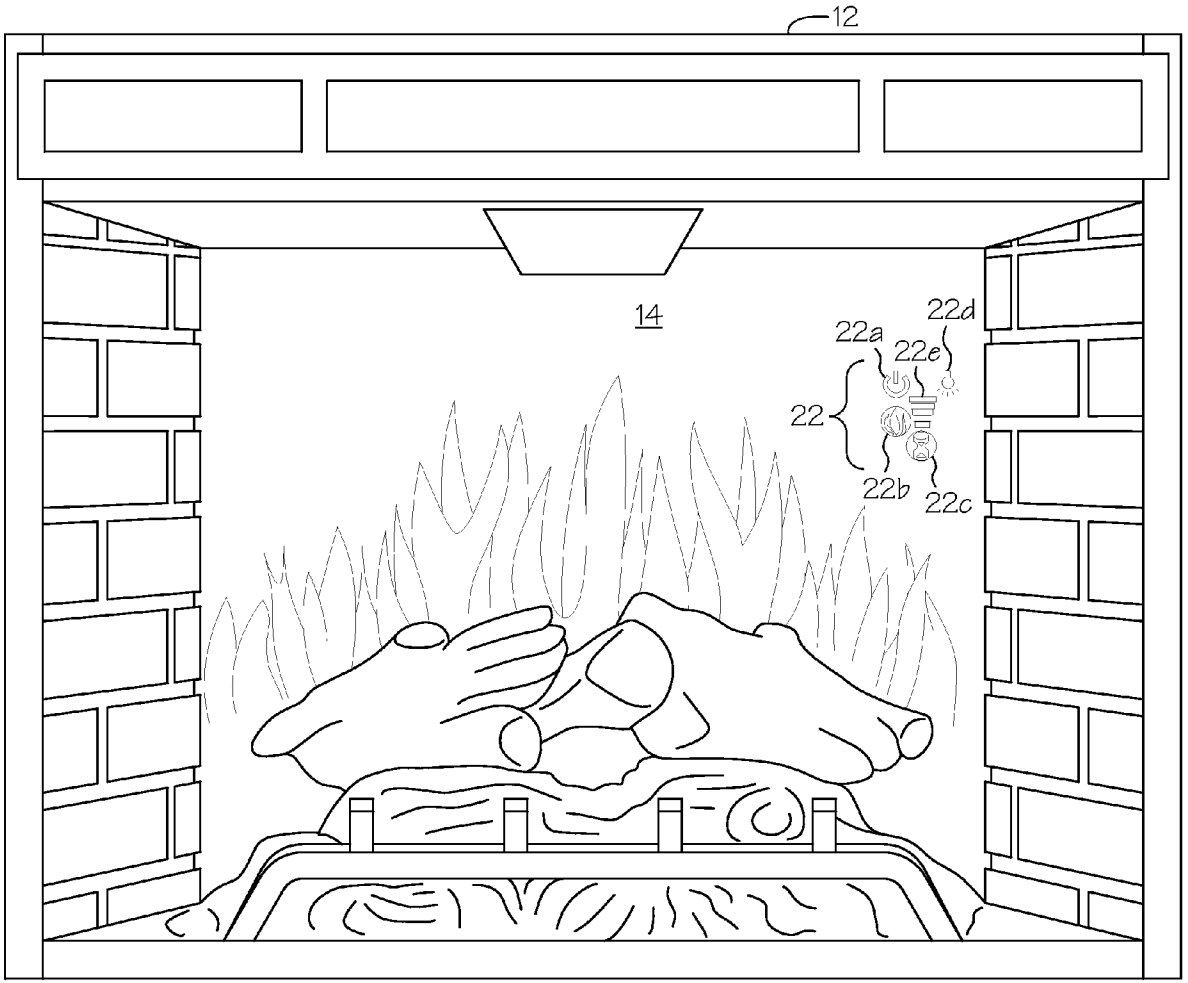
FIG. 1 is a front view of an electric fireplace having a function indicator system.
Figure 5:
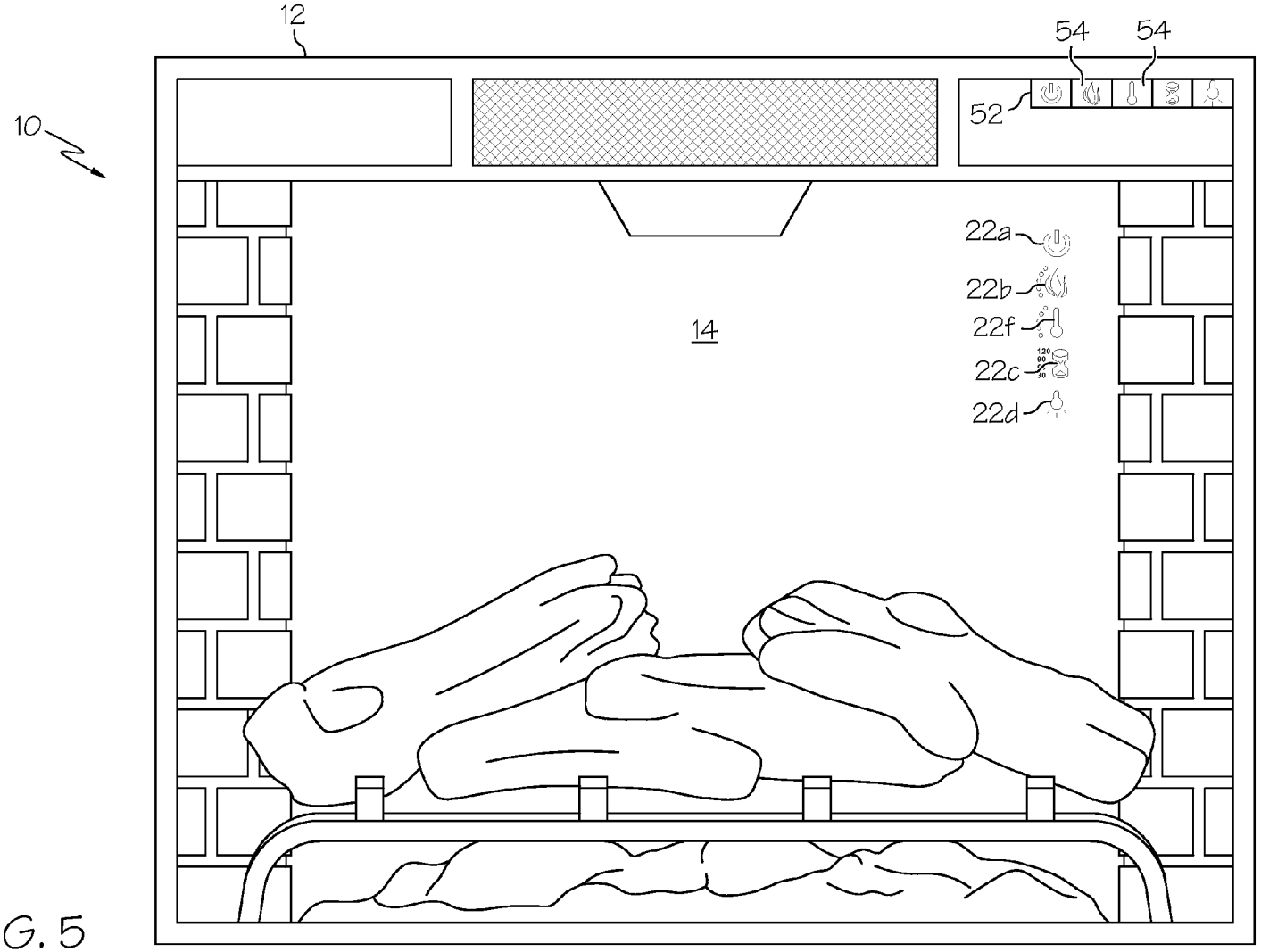
FIG. 5 is a front view of the electric fireplace of FIG. 4 with a visual display of control settings projected onto the projection screen so as to be visible on an exterior surface of the projection screen.

The invention provides systems for displaying the control settings for an electric fireplace, which govern the features and functions of the electric fireplace. In an exemplary embodiment, the system 10 can include an electric fireplace 12 featuring a projection screen 14, a function indicator module 16, a controller 18, and a power source 20. FIG. 1 shows an electric fireplace 12 with control setting status visibly displayed in a visual status display 22 on the projection screen 14 for (starting at top left and moving counterclockwise) power (on/off) control 22*a*, simulated flame intensity control 22*b*, timer control 22*c*, and light brightness or intensity control 22*d*. A status bar or level status indicator 22*e* is pictured in the center of the visual status display 22. The visual status display 22 can also include a temperature control 22*f* as shown in FIG. 5.

Figure 2:
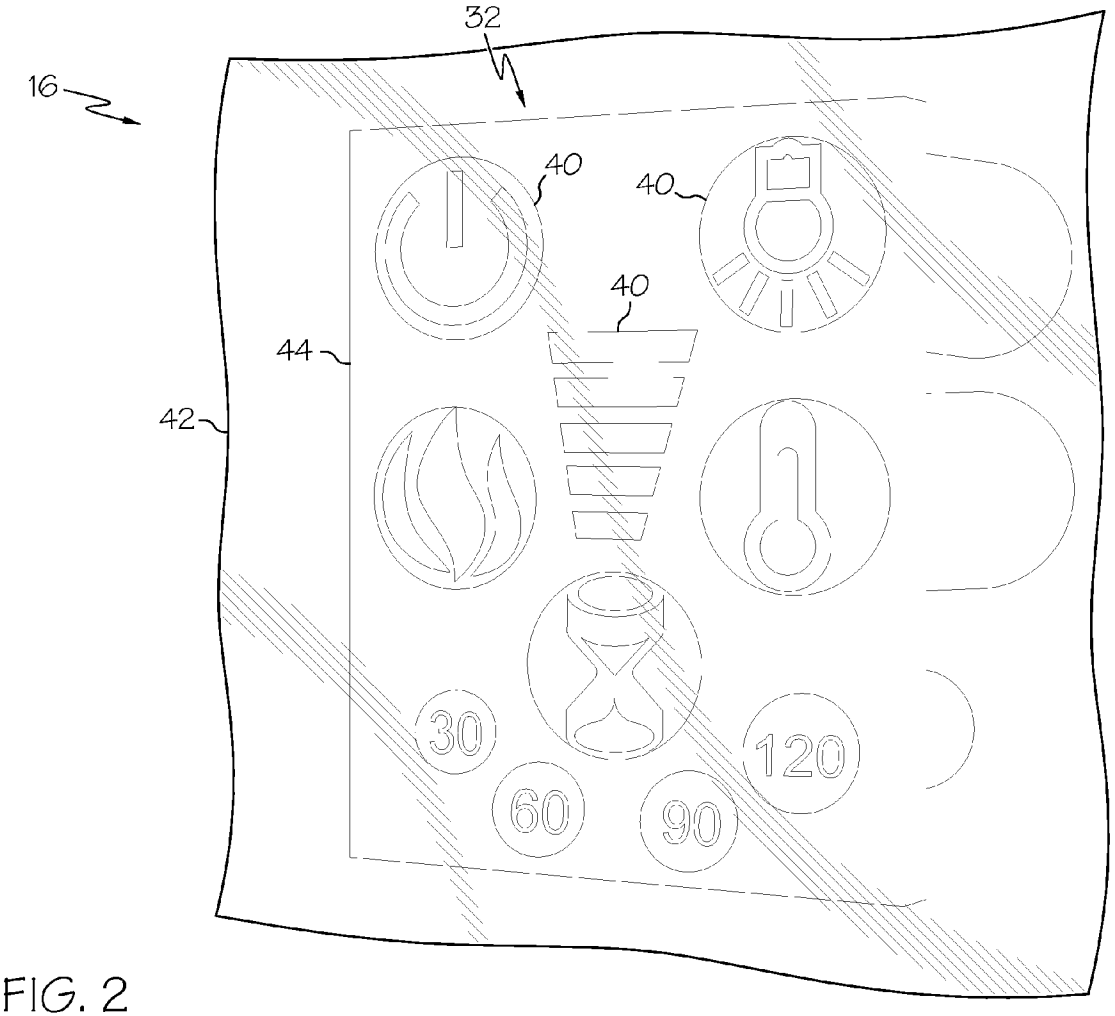
FIG. 2 is a front perspective view of a function indicator module of the function indicator system of FIG. 1.
Figure 3:
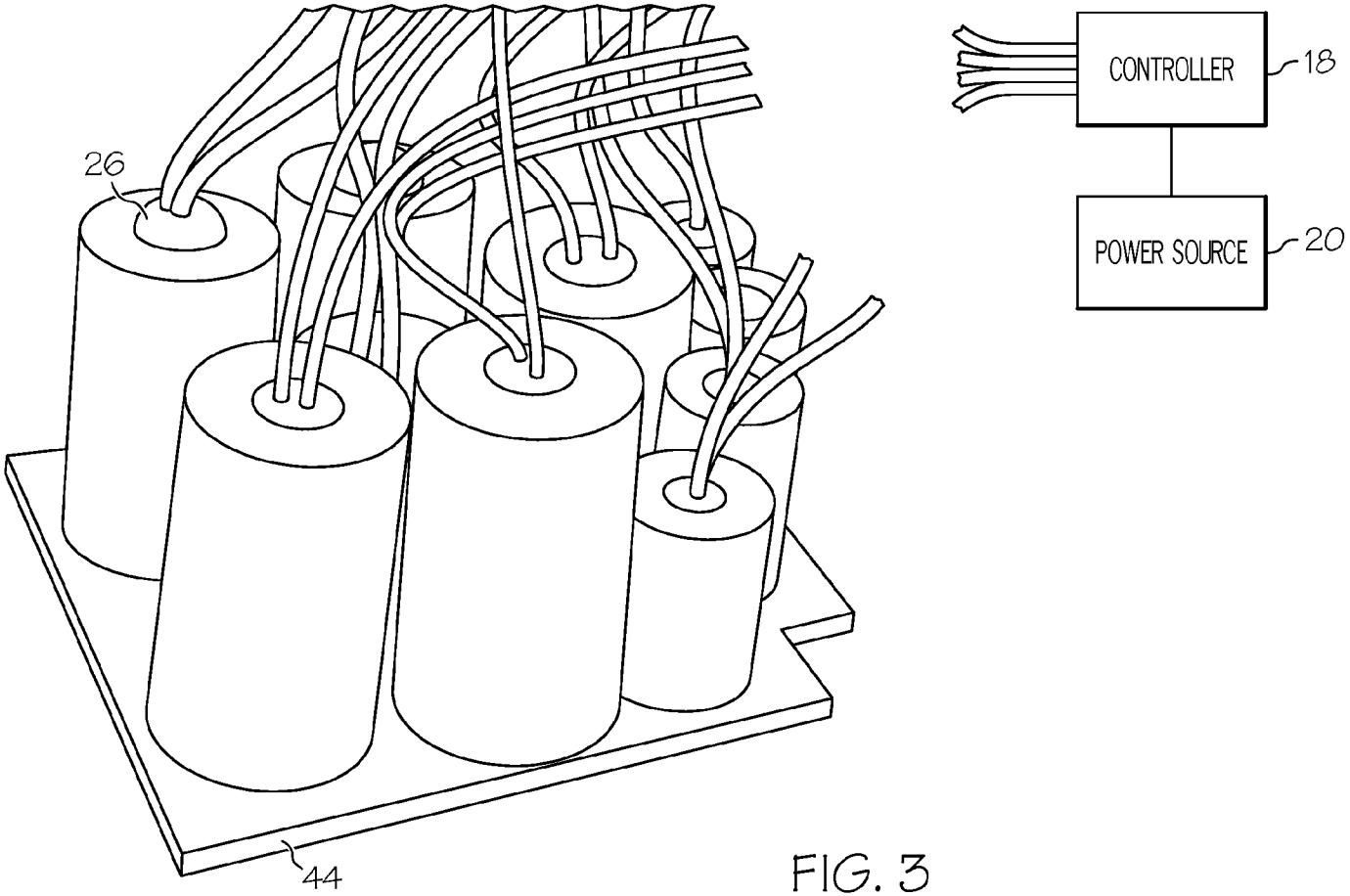
FIG. 3 is a rear perspective view of the function indicator module of FIG. 2.
Figure 8:
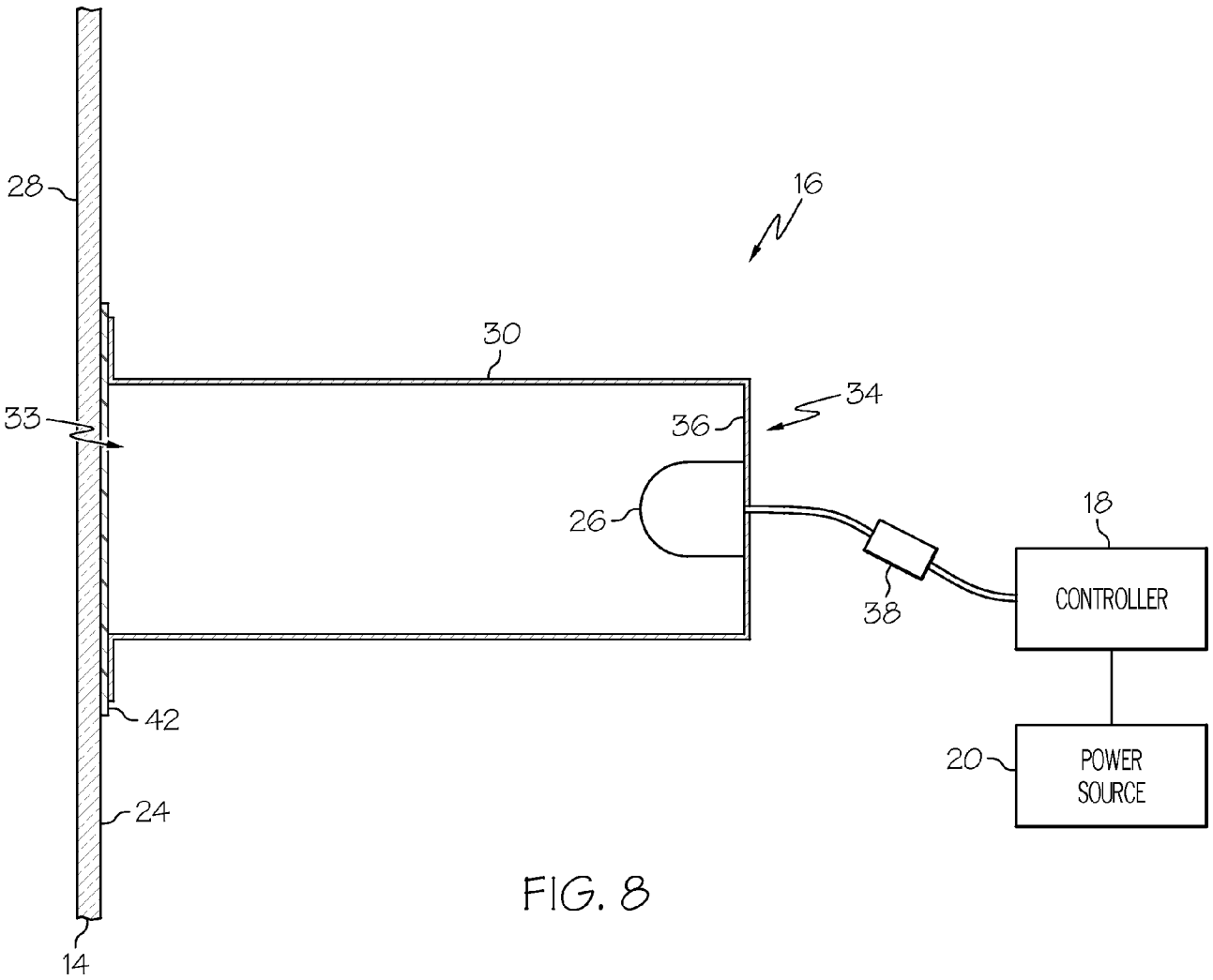
FIG. 8 is a cut-away side view of an electric fireplace and function indicator system.

FIGS. 2 and 3 illustrate one embodiment of the function indicator module 16. The function indicator module 16 can be installed on one side of the projection screen to create the visual status display 22 of the electric fireplace's control settings on the projection screen 14. In an exemplary embodiment, the function indicator module can be installed behind the projection screen as shown in FIG. 8. The function indicator module may be positioned in close proximity to an interior surface 24 of the projection screen 14, or in another embodiment, the function indicator module may be installed in contact with the interior surface 24.

The function indicator module 16 can include at least one function indicator light 26. In exemplary embodiments, the function indicator module can include a plurality of function indicator lights 26 each of which can be independently controlled by the controller 18 as a function of selections made by a user with respect to the control settings levels or status of each user-controllable function and feature of the electric fireplace. Each function indicator light can also be connected to the power source 20. The function indicator lights 26 can be any suitable light source including, for example, incandescent or fluorescent lights, but in an exemplary embodiment, light emitting diodes (LEDs) will be used. A single color of LEDs can be used or, in other embodiments, multiple different colors or LEDs may be incorporated in the function indicator module.

Each function indicator light 26 can produce a separate visual status display 22 on the interior surface 24 of the projection screen 14 that is visible to viewers on an exterior surface 28 of the projection screen. Control settings that may be projected onto the projection screen by the function indicator module 16 can include, for example, settings for control status related to power, temperature, light brightness or intensity and power, blower or fan speed, timer, simulated flame control, and speaker volume for a burning wood soundtrack that may be used to imitate the sounds associated with actual burning wood.

In an exemplary embodiment, the function indicator module 16 can include a housing 30, at least one function indicator light 26, and a visual display apparatus 32. The housing 30 may be a container featuring an opposing open end 33 and closed end 34 and a plurality (e.g., four) walls. The function indicator light or lights can be installed on an interior surface 36 of the closed end 34 of the housing 30. The visual display apparatus 32 can be installed over and in contact with the open end 33 of the housing 30. In another embodiment, the visual display apparatus 32 can be installed in front of but not in direct contact with the open end of the housing.

Figure 4:
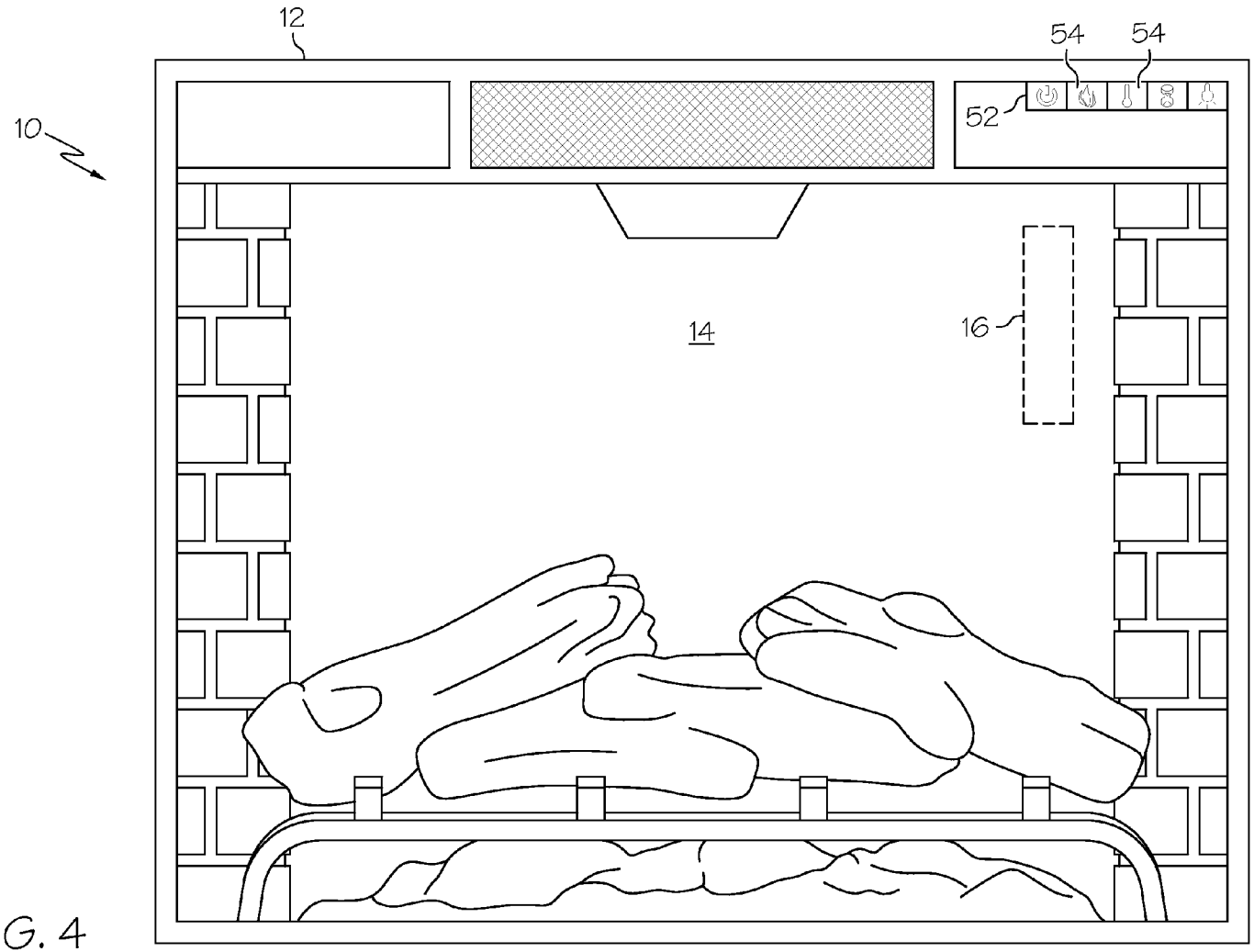
FIG. 4 is a front view of an electric fireplace with the function indicator module shown in phantom behind a projection screen of the electric fireplace.

The function indicator module 16 can be connected to a timer-controlled dimmer 38. After a predetermined period of time during which the visual status display 22 is projected at full brightness or intensity onto the projection screen 14, the dimmer 38 can be programmed to begin decreasing the brightness or intensity of the light emitted by the function indicator lights 26. At a predetermined level of brightness or intensity, the dimmer can then turn off the function indicator lights entirely causing the visual status display 22 to fade and disappear from the projection screen as shown in FIG. 4.

The visual display apparatus 32 of the function indicator module 16 can feature control status indicia 40. The control status indicia 40 can be semitransparent or opaque so that light must pass around them to form a predetermined pattern or shape on the projection screen 14. The control status indicia 40 can be printed on a translucent film or other semitransparent material. In another embodiment, the control status indicia can be rigid or semi-rigid cut-outs constructed in a shape that permits the function indicator module to project light in a predetermined, desired pattern onto the projection screen. The shapes and patterns formed by light passing through or around the visual display apparatus 32 form the visual status display 22 projected onto the projection screen 14.

Figure 6A:
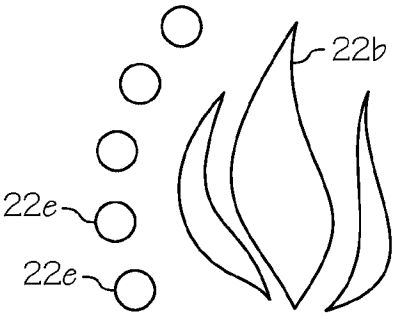
FIG. 6A is a close-up view of a flame intensity control setting status indicator.
Figure 6B:
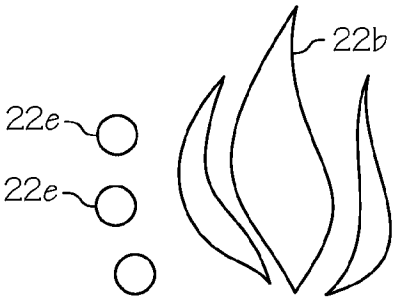
FIG. 6B is a close-up view of another flame intensity control setting status indicator.
Figure 6C:
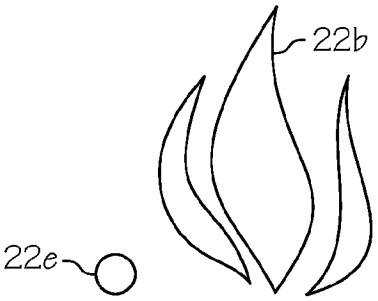
FIG. 6C is a close-up view of still another flame intensity control setting status indicator.
Figure 7A:
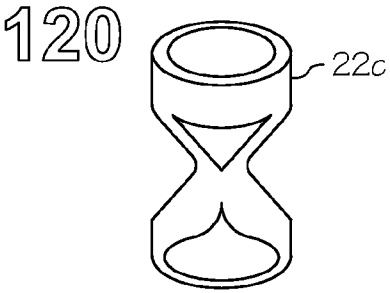
FIG. 7A is a close-up view of a temperature control setting status indicator.
Figure 7B:
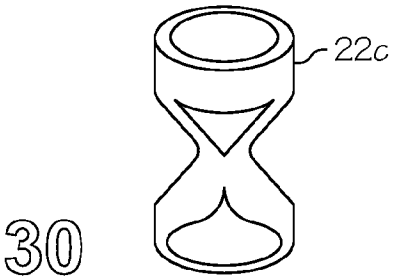
FIG. 7B is a close-up view of another temperature control setting status indicator.

Examples of patterns and shapes of control status indicia that may be used by the invention include patterns and shapes similar to those of the visual status displays shown in FIGS. 6A-7B. FIG. 6A-6C show three embodiments of a visual status display for simulated flame intensity control 22*b* with status level indicators 22*e* of high, intermediate, and low intensities, respectively. FIGS. 7A and 7B show two embodiments of a visual status display for timer control 22*c* with status level indicators of 120-minute time period before shutdown and 30-minute time period before shutdown, respectively. At the expiration of a selected time period using the timer control setting, the electric fireplace can automatically power off.

In one embodiment, the visual display apparatus 32 can include a translucent film 42 that can feature printed control status indicia 40. The translucent film 42 can be attached over the open end 33 of the housing 30 so that each of the film's printed control status indicia are aligned with and receive light emitted by an individual function indicator light or group of lights 26 selected by the manufacturer during construction of the function indicator module. The translucent film can be colorless or tinted with color.

Figure 9:
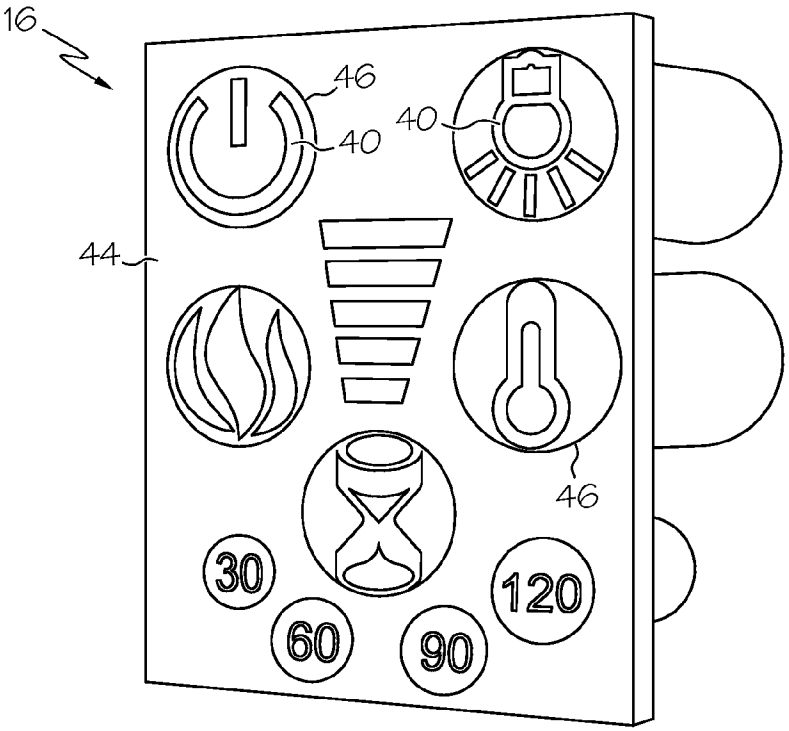
FIG. 9 is a front perspective view of another embodiment of a function indicator module.

In another embodiment, shown in FIG. 9, the visual display apparatus 32 can feature an opaque plate 44 that includes at least one translucent section 46 in alignment with a path of light emitted by a selected function indicator light 26. The opaque plate 44 can be attached over the open end 33 of the housing 30. Each translucent section 46 can include printed control status indicia 40, which can be either semi-transparent or opaque. The translucent sections can be colorless or tinted with color.

Figure 10:
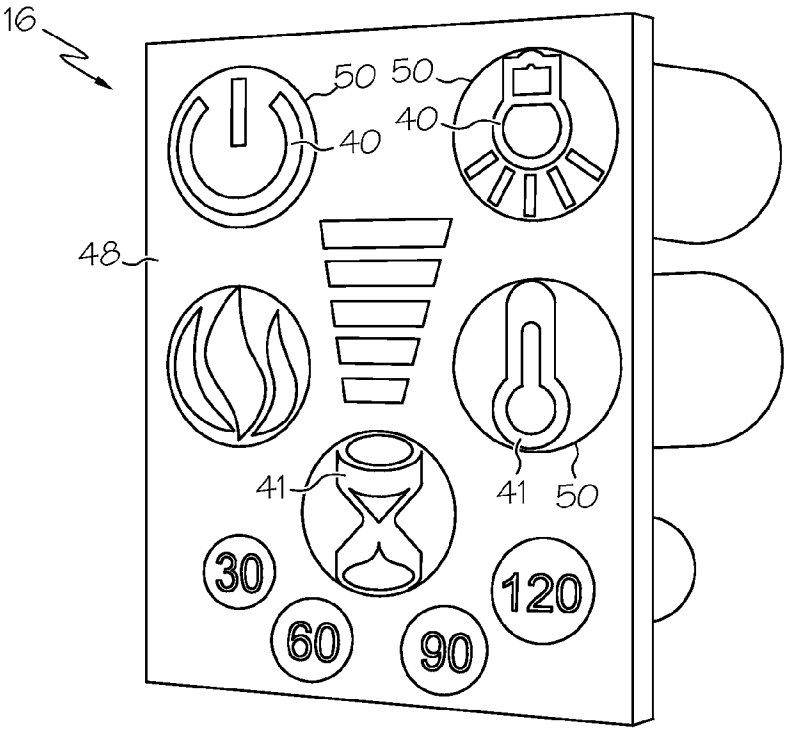
FIG. 10 is a front perspective view of still another embodiment of a function indicator module.

In yet another embodiment, shown in FIG. 10, the visual display apparatus 32 can feature an opaque plate 48 having at least one aperture 50. Each aperture 50 can be aligned with a path of light emitted by at least one function indicator light 26. The opaque plate 48 may include control status indicia 41 positioned within the path of light passing through each aperture 50.

The controller 18 can be communicatively connected to the function indicator module 16, and the power source 20 can be electrically connected to the function indicator module. In one embodiment of the invention, the controller 18 can be a computer. In another embodiment, the controller 18 can be a circuit board that features input and output ports to which the function indicator module is electrically and communicatively connectable. The controller can feature a user control interface 52 that can include at least one set of control features such as, for example, control buttons 54 as shown in FIG. 5, a touchscreen comprising electronically displayed control keys, or a wireless remote control.

The power source 20 can be any suitable power source such as, for example, connection to an electrical grid via an electrical outlet, a battery, or an alternative power supply, e.g., connection to a solar panel or wind turbine. The electric fireplace, function indicator module, and controller may be connected to the same power source or to different power sources.

The invention also features methods for visually displaying the control settings of an electric fireplace. The method can include the step of projecting light emitted by a light source through a function indicator module. The function indicator module can feature control status indicia. In the next step, light passing through the control function indicator module can be projected onto a projection screen of an electric fireplace to create a visual display of the electric fireplace's control settings on an exterior surface the projection screen. In another step, a user can vary the characteristics of the visual display by changing the user's control input selections related to control of the electric fireplace's control settings.

In another embodiment, the method can also include the step of projecting the visual display onto the projection screen for a predetermined period of time. The method can further include a step in which the light source creating the visual display can be dimmed after a predetermined period of time. The light source can be dimmed until the light source is turned off and the visual display disappears from the exterior surface of the projection screen.

Other Embodiments

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. A system for displaying the control settings for an electric fireplace, the system comprising:

an electric fireplace comprising a non-electric projection screen;

a function indicator module with at least one function indicator light installed approximately adjacent to an interior surface of the non-electric projection screen for creating a non-video visual status display of the electric fireplace's control settings that is projected onto the non-electric projection screen such that the non-video visual status display and function indicator module are substantially hidden from view when the at least one function indicator light is not illuminated;

a controller communicatively connected to the function indicator module to control a dimmable brightness of light emitted by the at least one function indicator light; and a power source;

wherein at least part of the visual status display is viewable from an exterior surface of the non-electric projection screen when the at least one function indicator light is illuminated;

wherein the non-video visual status display comprises patterns or shapes comprised of light that passes through or around a visual display apparatus and is projected onto the non-electric projection screen.

2. The system of claim 1, wherein the at least one function indicator light emits a path of light.

3. The system of claim 2, wherein the at least one function indicator light comprises a light-emitting diode.

4. The system of claim 2, wherein the non-video visual status display of the at least one function indicator light comprises patterns or shapes corresponding to at least one of the following settings: power, temperature, light brightness, blower or fan speed, timer, flame control, and speaker volume.

5. The system of claim 1, wherein the function indicator module varies the non-video visual status display displayed on the non-electric projection screen based upon a user's selection of control settings levels.

6. The system of claim 1, wherein the function indicator module comprises:

a housing comprising an open end and a closed end;

at least one function indicator light installed on an interior surface of the closed end of the housing; and the visual display apparatus installed over the open end of the housing.

7. The system of claim 6, wherein the visual display apparatus comprises a translucent film comprising printed control status indicia.

8. The system of claim 6, wherein the visual display apparatus comprises an opaque plate comprising at least one translucent section in alignment with a path of light emitted by the at least one function indicator light.

9. The system of claim 8, wherein the at least one translucent section comprises printed control status indicia.

10. The system of claim 6, wherein the visual display apparatus comprises an opaque plate comprising at least one aperture aligned with a path of light emitted by the at least one function indicator light.

11. The system of claim 10, wherein the opaque plate comprises control status indicia positioned within the path of light passing through the at least one aperture.

12. The system of claim 1, wherein the function indicator module is installed behind an interior surface of the non-electric projection screen to project the non-video visual status display onto the interior surface of the non-electric projection screen.

13. The system of claim 1, wherein the function indicator module is installed on an interior surface of the non-electric projection screen.

14. The system of claim 1, wherein the function indicator module is connected to a timer-controlled dimmer to control the dimmable brightness of the light.

15. The system of claim 1, wherein the controller comprises a user control interface comprising at least one set of control features selected from the group consisting of: control buttons, a touchscreen comprising electronically displayed control keys, and a remote control.

16. The system of claim 1, wherein the controller is a computer comprising a user control interface with control features.

17. The system of claim 1, wherein the controller is a circuit board comprising input and output ports to which the function indicator module is electrically and communicatively connectable.

18. A method for visually displaying the control settings of an electric fireplace, the method comprising the steps of:

(a) projecting light emitted by a light source through a function indicator module comprising control status indicia;

(b) projecting light passing through the control function indicator module onto a non-electric projection screen of an electric fireplace to create a non-video visual display of the electric fireplace's control settings on an exterior surface the non-electric projection screen;

(c) varying the characteristics of the non-video visual display depending upon input from a user controlling the electric fireplace's control settings;

(d) projecting the visual display onto an interior surface of the non-electric projection screen for a predetermined period of time determinable by programming of a timer-controlled dimmer; and (e) dimming the light source creating the visual display after a predetermined period of time until the light source is turned off and the non-video visual display disappears from the exterior surface of the non-electric projection screen;

wherein the at least part of the non-video visual status display is viewable from an exterior surface of the non-electric projection screen when at least part of the function indicator module is illuminated;

wherein the non-video visual status display comprises patterns or shapes comprised of light that passes through or around a visual display apparatus and is projected onto the interior surface of the non-electric projection screen so as to be visible on the exterior surface of the non-electric projection screen.

* * * * *